United States Patent [19]

Kuhr

[11] 4,294,054

[45] Oct. 13, 1981

[54] SOFFIT SYSTEM FOR SUSPENDED CEILING

[75] Inventor: Albert F. Kuhr, Elk Grove Village, Ill.

[73] Assignee: United States Gypsum Company, Chicago, Ill.

[21] Appl. No.: 65,398

[22] Filed: Aug. 9, 1979

[51] Int. Cl.[3] ..... E04B 5/52

[52] U.S. Cl. ..... 52/484; 52/282; 52/727; 52/773

[58] Field of Search ..... 52/484, 727, 747, 773, 52/824, 826, 282

[56] References Cited

U.S. PATENT DOCUMENTS

| | | | |
|---|---|---|---|
| 2,318,092 | 5/1943 | Olsen . | |
| 2,481,794 | 9/1949 | Stitt | 52/773 X |
| 2,734,126 | 2/1956 | Kruger . | |
| 2,888,113 | 5/1959 | Schwartz et al. . | |
| 2,909,355 | 10/1959 | Nelson . | |
| 3,334,465 | 8/1967 | Hoffmann, Jr. | 52/484 X |
| 3,456,409 | 7/1969 | Piget | 52/773 X |
| 3,628,299 | 12/1971 | Nakazawa | 52/488 |
| 3,690,243 | 9/1972 | Lambert | 52/484 |
| 3,696,571 | 10/1972 | Schluter | 52/144 |
| 3,785,110 | 1/1974 | Galloway et al. | 52/484 X |
| 3,835,606 | 9/1974 | Liberman | 52/484 |
| 3,848,385 | 11/1974 | Thompson | 52/484 X |
| 3,998,020 | 12/1976 | Kuhr | 52/484 |
| 3,998,419 | 12/1976 | Semmerling | 52/484 X |
| 4,189,893 | 2/1980 | Kuhr | 52/484 |

FOREIGN PATENT DOCUMENTS

| | | | |
|---|---|---|---|
| 674081 | 4/1966 | Belgium | 52/484 |

*Primary Examiner*—Alfred C. Perham

*Attorney, Agent, or Firm*—Robert M. Didrick; Robert H. Robinson; Glenn W. Ohlson

[57] ABSTRACT

A decorative soffit system for mounting on the bottom of vertically disposed ceiling tile to enclose a projection depending from the ceiling as disclosed. The soffit system having a U-shaped channel member adapted to rest on an inverted-T runner and said U-shaped channel member having a resilient spacer therein to hold a vertically disposed ceiling tile against one side thereof.

1 Claim, 3 Drawing Figures

SOFFIT SYSTEM FOR SUSPENDED CEILING

BACKGROUND OF THE INVENTION

1. Field of the Invention

The invention relates to a decorative soffit system for mounting on the bottom of vertically disposed ceiling tile to enclose projections depending from the normal ceiling plane.

2. Description of the Prior Art

Suspended ceiling systems which use inverted-T runners have wide usage in residential and industrial construction. Frequently, the normal plane of the ceiling cannot be continued through portions of a full room size due to depending projections. Projections normally encountered are air ducts, beams, pipes, utility boxes, electrical wiring, and the like. Since it would be undesirable to drop the overall plane of the ceiling to the minimum level required below the deepest of such projections, a soffit construction is typically envisioned for encasing these items.

It would be desirable, considering the wide variety of presently used suspended ceiling systems, to provide a soffit system which is adaptable for use with this assortment, particularly systems utilizing inverted-T runners for ceiling tile support. Such systems typically involve the suspension of inverted-T runners by hanger wires, clips, or adjustable brackets to facilitate leveling. Although particular systems may have soffit members, they usually require specific accommodating features for use in that one system. Moreover, with the wide usage by the individual home owner in constructing suspended ceilings, it would be desirable to accommodate many types of suspended ceiling system designs with a soffit system adaptable for use therein. Typically, in single family residential construction particularly, many depending utility devices exist, such as in basements, where ceiling concealment is desired. It would be most useful in these cases to provide a decorative soffit system which encases such projections without the need for complicated erection procedures and a multiplicity of specialized components.

The particular problems discovered in many prior art ceiling systems involve the proper location and retention of the vertical ceiling tiles, which are disposed alongside the depending projection, and lower support while yet maintaining esthetically pleasing bottom and corner portions. It would be useful to support the lower edges of such vertically extending ceiling tile without the need for rigid mechanical affixation by nails, screws, or the like. This would alleviate additional construction steps and also permit the use of leveling brackets such that the bottom surface of the enclosing soffit structure could be easily aligned parallel planar with the normal ceiling plane.

Moreover, many residential and commercial suspended ceiling systems utilize basically three types of tile edges for various decorative configurations. One conformation is a simple square-edged tile which rests atop flanges of inverted-T runners. A second tile construction has longitudinal kerfing centrally located in the tile edge which accept the flanges of inverted-T runners and conceal them within the kerf. A third type of edge is a rabbet, or notched, design which disposes the lower visible tile surface below the level of the flanges of the inverted-T runner. It would clearly be advantageous to provide a soffit system which is compatible with all three of these basic edge configurations without the need for structural changes in order to enclose such aforementioned depending projections and appurtenances.

In typical installation, main-runners are generally transposed at right angles to upper support joist members with cross-runners transverse thereto. Occasionally, such systems eliminate cross-runners and spline members connect adjacent ceiling tile at joints transverse to the main-runners. Such systems are additionally installable with main-runners being parallel to upper joist members. In either situation, it would be highly desirable to provide a soffit system which would be adaptable to cover depending ceiling projections which run either parallel or transverse to the upper support joist members without the need for special construction techniques or additional components.

OBJECTS OF THE INVENTION

It is a primary object of this invention to provide a decorative soffit system for mounting on the bottom of vertically disposed ceiling tile to enclose a projection depending from a ceiling.

It is accordingly an important object of this invention to provide a suspended ceiling boxed around a projection depending from a ceiling.

It is an attendant object of this invention to provide a soffit system for enclosing projections from the ceiling in a suspended ceiling system which utilize conventional inverted-T runners.

It is therefore a goal of this invention to provide a soffit system for enclosing such depending projections wherein ceiling tile may have kerfed, square, or rabbet edges.

It is also an object of this invention to provide a soffit system which is adaptable for use with suspended ceiling systems wherein main-runners run either parallel or transverse to upper support joist members and wherein depending projections from the ceiling run either parallel, or transverse, to such upper support joist members.

It is a concomitant object of this invention to provide a soffit system which requires no penetrating mechanical fastening at lower edges of vertically disposed soffit ceiling tile and is easily installable by the home consumer.

It is also a goal of this invention to provide a soffit system for both residential and commercial use for enclosing depending projections from the ceiling wherein vertically disposed ceiling tile comprise the side facing of the box-like enclosure for the projection and wherein a ceiling tile is disposed below said projection in parallel planar relationship with the normal plane of the ceiling.

SUMMARY OF THE INVENTION

All the objects and goals of the invention are attained by the provision of a unique decorative soffit system for mounting on the bottom of vertically disposed ceiling panels to enclose a projection depending from a ceiling. The system has a U-shaped channel member adapted to rest on an inverted-T runner and said U-shaped channel member also has a resilient spacer therein to hold the vertically disposed ceiling tile therein against one side thereof.

The goals of the invention are further attained by providing a supported inverted-T runner, a U-shaped channel member resting on one side of the inverted-T runner, a vertically disposed ceiling tile resting in the U-shaped channel member on the side opposite the inverted-T runner, and, means within the U-shaped channel member to hold the vertically disposed ceiling tile against the side thereof.

In further fulfilling the needs of the industry, a suspended ceiling is provided for boxing around a projection depending from ceiling joists. The suspended ceiling system comprises a plurality of suspension brackets depending from the ceiling and terminating at the bottom thereof in inverted-T runners, a plurality of ceiling tiles resting on the inverted-T runners, and, at least one U-shaped channel resting on an inverted-T runner adjacent to the projection depending from the ceiling and having a vertically disposed ceiling tile resting therein, and means for holding the ceiling tile against the side of the U-shaped channel member.

In further fulfilling the desirable goals of the invention, an apparatus is provided for use in the soffit system for enabling a decorative suspended ceiling system to be boxed around a projection depending from a ceiling joist, said apparatus comprising a U-shaped channel member with a decorative outside surface.

DESCRIPTION OF THE PREFERRED EMBODIMENT

Figure 1:
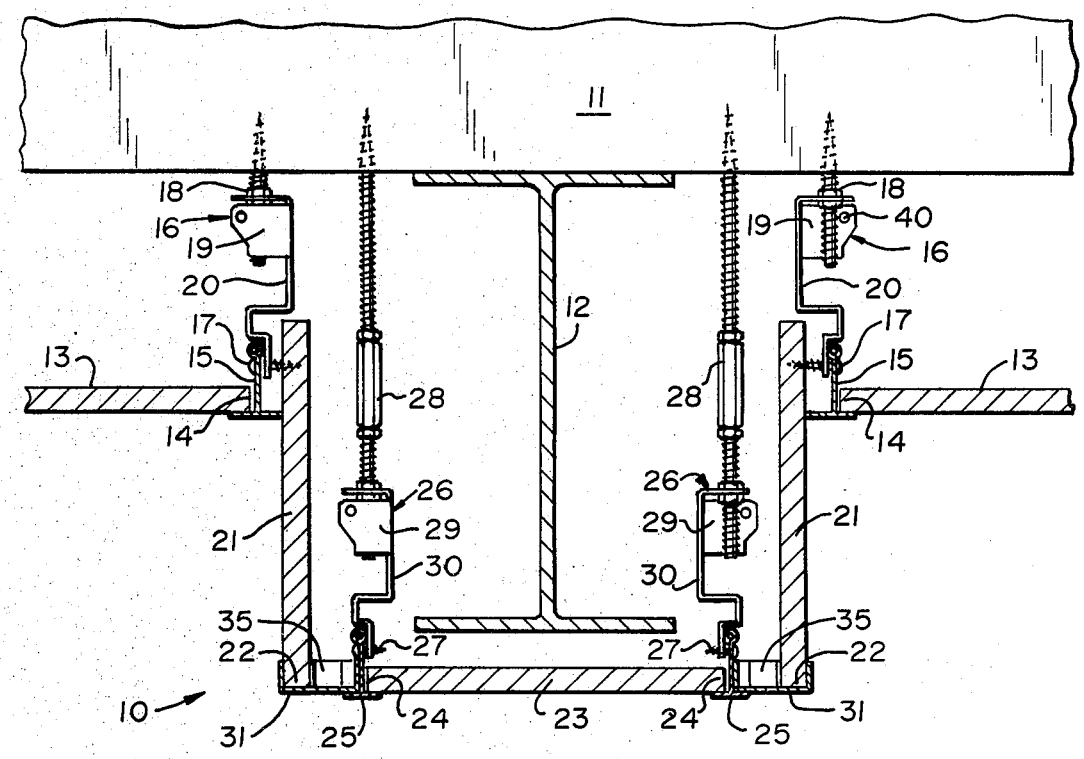
FIG. 1 is a cross-sectional view illustrating the preferred embodiment for the soffit system of this invention boxing around a beam supported transverse to an upper support joist member which is a support for a suspended ceiling system.

The soffit system for suspended ceiling system of this invention is more fully described by reference to the embodiments illustrated in the attached drawings wherein, with first reference to FIG. 1, soffit system 10 is depicted in a cross-sectional view. Upper support joist 11 has beam 12 projecting downwardly therefrom. Disposed below, providing the normal plane of the ceiling, resides ceiling tile 13 in parallel planar relationship having edges 14 supported at and along inverted-T runners 15. Connecting inverted-T runners 15 with upper support joists 11 are adjustable brackets 16 attached thereto by screw fasteners 17. In order to level ceiling tile 13 after installation, adjustable means 18 comprises part of adjustable bracket 16. Adjustable bracket 16 further has alternate attachment plate 19 disposed at 90° to question mark-shaped body portion 20. Adjacent inverted-T runners 15 at the side opposite ceiling tile 13, reside ceiling tile 21 disposed in a vertical orientation and providing the decorative side facing for the enclosing box-like configuration of soffit system 10. Inverted-T runners 15 secure ceiling tile 21 with said screw fastener 17 passing through the web of the runner and extending into the ceiling tile 21.

A characterizing feature of this invention, shown in FIG. 1, involves the connection at lower edges 22 of ceiling tile 21 with decorative members and supportive members whereby projections from ceilings may be easily enclosed in a sturdy soffit structure. A second set of brackets being adjustable brackets 26 extend from upper joist 11 for support of a lower set of runners being inverted-T runners 25 which are conventionally used flanged runners. Adjustable brackets 26 engage inverted-T runners 25 by means of screw fasteners 27 extending therethrough. In order to level lower ceiling tile 23 of soffit system 10, adjustable means 28 comprises part of adjustable bracket 26 and affords leveling during installation procedures such that ceiling 23 may be placed in parallel planar relationship with ceiling tile 13. Adjustable brackets 26 are substantially identical to adjustable brackets 16 with regard to alternate attachment plate 29 residing at generally 90° relationship with the question mark- shaped body portion 30. In order to effectively support ceiling tile 21 in a vertical orientation while at the same time providing a decorative lower portion for soffit system 10, U-shaped channel 31 is provided and interconnects lower edge 24 with inverted-T runners 25. Thus ceiling tile 21 rests within U-shaped channel 31. Disposed between ceiling tile 21 and inverted-T runner 25 is resilient clip 35 which upon installation effectively retains ceiling tile 21 in position within U-shaped channel 31 and additionally allows removability for access within the enclosure since no mechanical affixation at lower edge 24 is required. U-shaped channel 31, at the side opposite ceiling tile 21, rests upon inverted-T runner 25 in supportive relationship thereto. Disposed between parallel adjacent inverted-T runners 25 is ceiling tile 23 having edges 24 resting on flanges of inverted-T runners 25 for support. U-shaped channels 31 are preferably comprised of light-gauge steel having an enamel finish which can be provided in various colors to coordinate in a decorative and esthetically pleasing combination with decorative lower flange portions of inverted-T runners 15 and 25 which are viewable from below.

Soffit system 10 as shown in FIG. 1 is provided wherein inverted-T runners 15 are main-runners supporting ceiling tiles 13 and are disposed transverse to upper support joists 11. It is readily apparent that main-runners, inverted-T runners 15, could be alternately disposed parallel to upper support joists 11 and thus in order to enclose beam 12, cross-runners would be disposed transverse to upper support joists 11 in an orientation which in cross-section, would appear substantially identical to the configuration shown in FIG. 1. Soffit system 10 is usable whether the orientation of main-runners is parallel or transverse to upper support members and in either case whether projections run parallel or transverse to upper support members.

Figure 2:
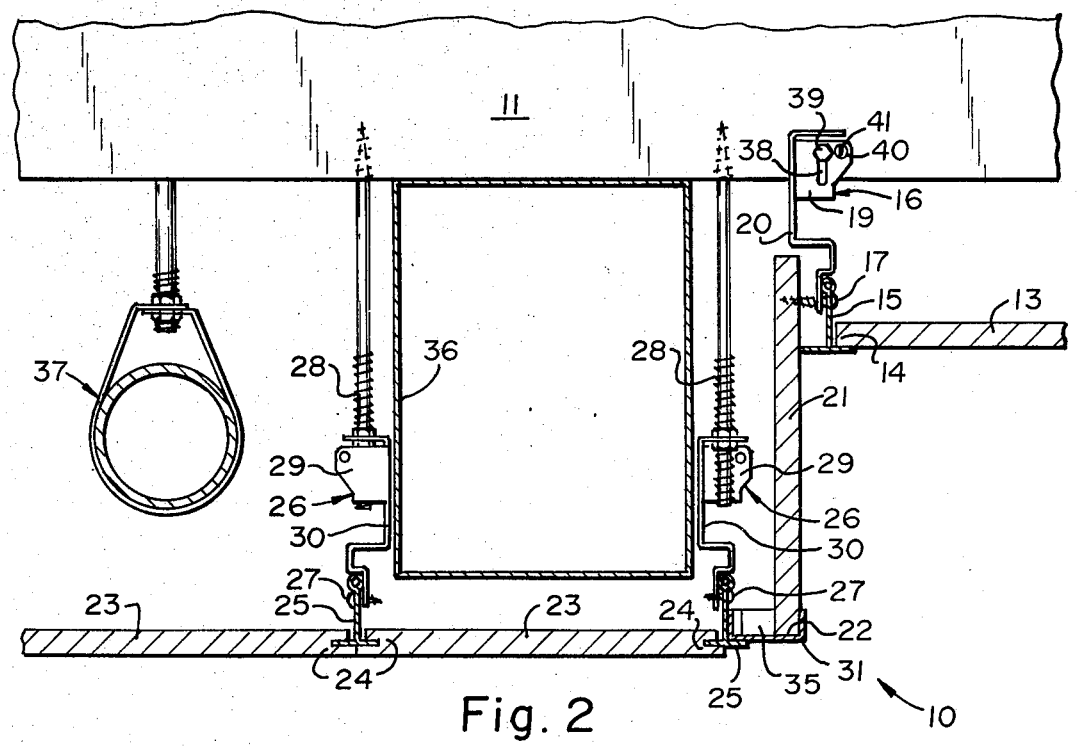
FIG. 2 is a cross-sectional view of a soffit system in accordance with the preferred embodiment of this invention showing an air duct and pipe depending from an upper support joist member with said air duct and pipe being enclosed by the soffit system.

Turning now to FIG. 2, soffit system 10 is shown in an altered conformation illustrating the versatility of the invention for use with multiple projections to be enclosed. In this Figure, an air duct 36 and pipe assembly 37 are enclosed. Similar to FIG. 1, FIG. 2 provides upper support joist 11 wherein an adjustable bracket 16 is dependent therefrom but having a different manner of vertical adjustability from that disclosed in FIG. 1. Differing from the embodiment shown in FIG. 1, adjustable bracket 16 is not provided with adjustable means 18 but vertical adjustment is alternately attained nonetheless whereby alternate attachment plate is vertically movable by means of slot 38 with fastener 39 extending therethrough. Slot 38 allows for adjustment by vertically moving it to position slot 38 and fastener 39 at the proper elevation. A second hole 40 allows rigid securement by means of fastener 41 extending therethrough after proper vertical alignment is attained. Attachment plate 19 is disposed at 90° with question-mark shaped body portion 20 wherein body portion 20 connects with inverted-T runners 15 by means of screw fasteners 17 extending therethrough. Ceiling tile 13, lying in the normal plane of the ceiling, has edge 14 resting on a flange of inverted-T runner 15 for support. Additionally, screw fastener 17 penetrates vertically disposed ceiling tile 21 for affixation thereto. Ceiling tile 21 terminates in a lower edge 22 resting within U-shaped channel 31 and resiliently spaced from inverted-T runners 25 by resilient clip 35.

Continuing with FIG. 2, adjustable brackets 26 depend from upper joist member 11 and secure inverted-T runner 25 below. Adjustable brackets 26 have adjustable means 28 for vertical alteration in order to properly level ceiling panel 23 below. Ceiling tile 23 is attached to inverted-T runners 25 which are supported by adjustable brackets 26. Ceiling tile 23 terminates in side edges 24 which in this configuration are shown to be kerfed edges nested around flanges of inverted-T runners 25. U-shaped channel 31 is supported at the flange opposite the attachment with lower edge 24 and provides a decorative surface when viewed from below. FIG. 2 additionally provides a second projection depending from the ceiling above, being pipe assembly 37, and a second ceiling tile 23 is shown disposed below to provide a lower ceiling surface for soffit system 10 enclosing both air duct 36 and pipe 37. Ceiling tile 23 below pipe assembly 37 is shown having side edge 24 also with a kerfed configuration nested around flanges of inverted-T runner 25 for support. A second vertically disposed ceiling tile 21, not shown, but, if required, could be placed at the other side of pipe 37 in a similar manner as shown in FIG. 1 for completing the enclosing of the projection by extending upward to the normal ceiling plane at a ceiling tile 13. If, however, pipe assembly 37 was adjacent a wall, a ceiling tile 21 would not be mandated and ceiling tile 23 would simply horizontally continue to supportively engage the wall.

Figure 3:
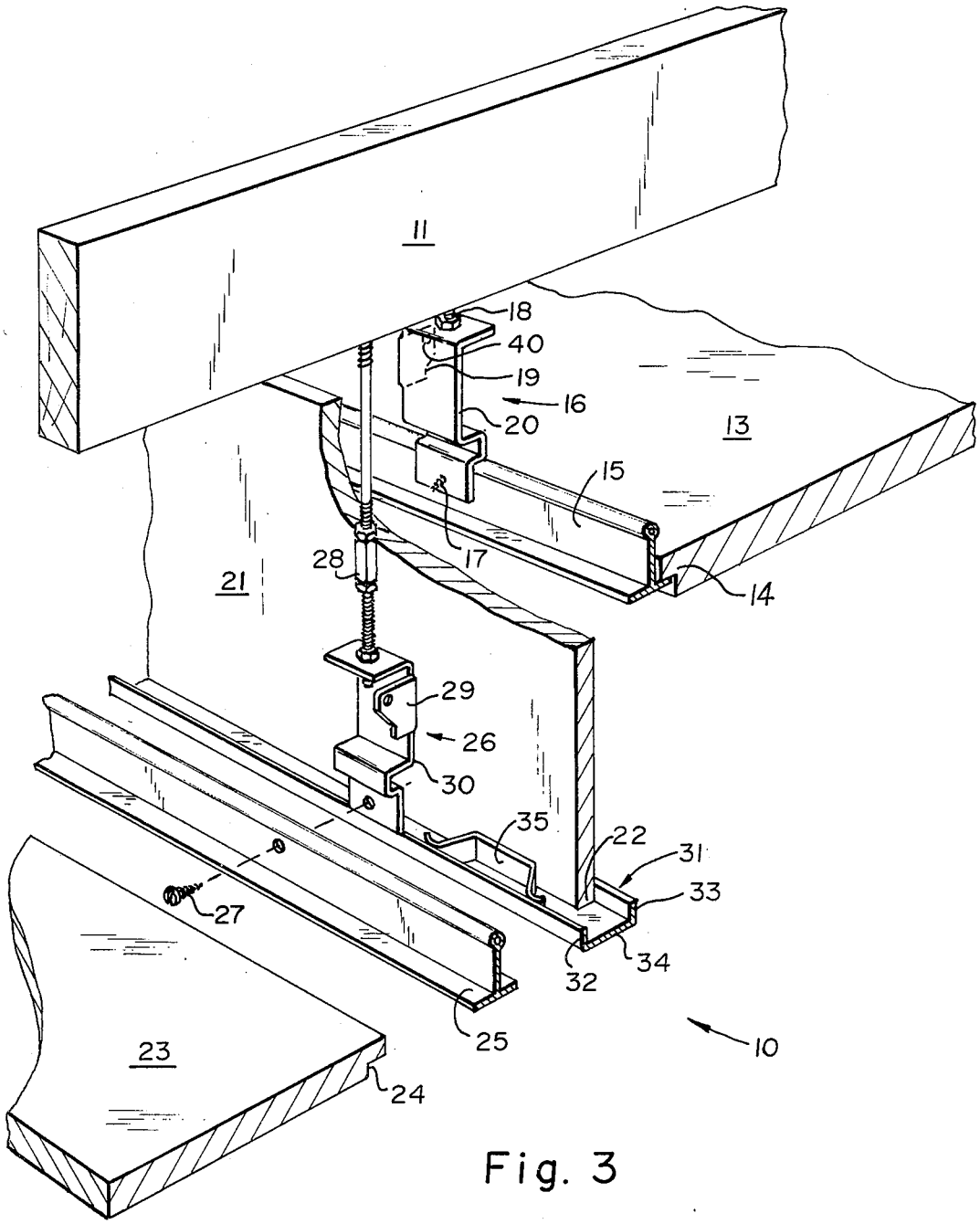
FIG. 3 is a partially blown apart perspective view looking downwardly at the preferred embodiment of the soffit system in this invention illustrating the enclosing for projections depending from a ceiling in a suspended ceiling system.

With reference to FIG. 3, soffit system 10 is shown in an exploded perspective view illustrating the characterizing novel elements therein provided. As previously discussed with regard to FIGS. 1 and 2, ceiling tile 13 is shown supported along flanges of inverted-T runners 15 which in turn are supported by adjustable brackets 16 depending from upper support joists 11. Adjustable brackets have screw fasteners 17 extending therethrough for supportive engagement with inverted-T runner 15. Additionally, adjustable bracket 16 has alternate attachment plate 19 disposed at substantially 90° to body portion 20 whereby affixation may be made with upper support joist 11 with attachable body portion 20 disposed at 90° rotation from the view shown in FIG. 3. Thus accommodation can be made for alignments wherein inverted-T runners 15 are either parallel or transverse to upper support joists 11 and whether projections to be enclosed are disposed in either orientation. Inverted-T runners 15, although shown preferably as main-runners, may be cross-runners of a suspended ceiling system in accordance with this invention. Adjustable means 18 additionally provides for any angle of disposition for projections in that the adjustable means allows omni-directional attachment for adjustable bracket 16. Such adjustable brackets are widely known to the construction industry and suitable apparatuses are disclosed in U.S. Pat. Nos. 3,998,020 and 3,998,419. Such and similar adjustable brackets, and other fixed brackets having a capability of at least attaching parallel or transverse to upper support joist members, are equally suitable for the invention.

Screw fastener 15 penetrates ceiling panel 21 for supportive engagement. Ceiling panel 21 is disposed in a vertical orientation providing the side face of soffit system 10 for enclosing projections depending from ceiling portions above. Lower edge 22 of ceiling panel 21 rests within U-shaped channel 31 below. U-shaped channel 31 is provided with a longer side 32 integrally connected with a bottom side 34 that terminates in a shorter side 33 creating a generally U-shape. Ceiling tile 21 abuts shorter side 33 and a resilient clip 35 extends between ceiling tile 21 and longer side 32 affording retentive positioning and removability of ceiling tile 21. Bottom side 34 rests on flanges of inverted-T runners 25 for support. Resilient clip 35 has a generally W-shape formed from light-gauge sheet steel and having a resilient property for securing ceiling tile 21. Disposed at the other side of inverted-T runner 25 is ceiling tile 23 providing the bottom planar surface of soffit system 10 wherein edges 24 supportively engage flanges of inverted-T runners 25. In this embodiment, edges 24 are provided with a rabbet, or notched edge, for a shadow-line effect well known to the construction industry. Supporting inverted-T runner 25 from above is adjustable clip 26 having a similar conformation to adjustable clip 16 and also having such suitable alternative embodiments as those shown in the aforementioned patents. Adjustable bracket 26 engages inverted-T runners 25 by screw fasteners 27 extending therethrough. Adjustable means 28 allows for vertical alterability of the brackets such that during installation ceiling tile 23 are placed in generally parallel planar relationship to ceiling tiles 13 for an esthetically pleasing and workmanlike soffit construction.

Ceiling tile 13 and 23 are preferably comprised of gypsum but may additionally be formed from other well-known construction materials such as wood fiber, mineral wool acoustical tile, wood, ceramic tile, and other well-known materials which are utilized in ceiling systems having inverted-T runners for support. Moreover, as seen in FIGS. 1–3, soffit system 10 of this invention is equally adaptable with varying edge configurations such as previously noted kerfed edge, rabbet edge, or square-edged ceiling tile.

The ease of installation is apparent with reference to the Figures. Whether utilized by the relatively unskilled home owner or the skilled tradesman, the effectiveness of this invention will be well understood. Resilient clip 35 effectively holds ceiling tile 21 within U-shaped channel 31 by its spring-like property. The material desirably comprising U-shaped channel 31 is enamel-covered light-gauge steel providing a decorative surface when viewed from below. Other well-known coatings or surface treatments may be provided for U-shaped channel 31 as would be well known to the metal-working arts. Not only is installation quick, but manufacture is reduced since a multiplicity of components is not required. Additionally, removability of soffit system 10 is provided, whereby access to utility appurtenances is readily available without prolonged time and effort.

It may thus be seen that the new and novel soffit system made possible by this invention is a highly adaptable enclosing apparatus for projections from a ceiling above that produces significant advantages over previously known soffit systems. While the invention has been described in conjunction with specific embodiments thereof, it is evident that alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A suspended ceiling boxed around a projection depending from ceiling joists, said suspended ceiling comprising in combination:

a plurality of suspension brackets depending from the ceiling and terminating at the bottom thereof in inverted-T runners;

a plurality of ceiling tiles resting on the inverted-T runners;

at least one U-shaped channel resting on an inverted-T runner adjacent to the projection depending from the ceiling and having a vertically disposed ceiling tile resting therein, and means for holding the ceiling tile against the side of the U-shaped channel member.

* * * * *